US006868980B2

(12) United States Patent
Schultz et al.

(10) Patent No.: US 6,868,980 B2
(45) Date of Patent: Mar. 22, 2005

(54) CONTAINER WITH DETACHABLE, SELECTIVELY VENTED LID

(75) Inventors: Marissa A. K. Schultz, Racine, WI (US); David H. Roland, Cedarburg, WI (US); Douglas Carpiaux, Milwaukee, WI (US); Jesse D. Cotterman, Grafton, WI (US)

(73) Assignee: S. C. Johnson Home Storage, Inc., Racine, WI (US)

( * ) Notice: Subject to any disclaimer, the term of this patent is extended or adjusted under 35 U.S.C. 154(b) by 0 days.

(21) Appl. No.: 10/462,163

(22) Filed: Jun. 16, 2003

(65) Prior Publication Data

US 2004/0251257 A1 Dec. 16, 2004

(51) Int. Cl.[7] ..... B65D 51/16

(52) U.S. Cl. ..... 220/367.1; 220/366.1; 220/675; 220/796; 220/801; 220/802

(58) Field of Search ..... 220/796, 799–802, 220/366.1, 367.1, 669, 675

(56) References Cited

U.S. PATENT DOCUMENTS

| | | | |
|---|---|---|---|
| 2,241,064 | A | 5/1941 | Harbison |
| 3,216,148 | A | 11/1965 | Amberg |
| 3,641,992 | A | 2/1972 | Peyser et al. |
| 3,717,478 | A | 2/1973 | Lipfert |
| 3,741,427 | A | 6/1973 | Doyle |
| 3,797,694 | A | 3/1974 | See et al. |
| 4,027,776 | A | 6/1977 | Douglas |
| 4,058,214 | A | 11/1977 | Mancuso |
| 4,144,968 | A | 3/1979 | Shelton |
| 4,478,349 | A | 10/1984 | Haverland, Jr. et al. |
| 4,512,497 | A | 4/1985 | Grusin |
| 4,537,325 | A | 8/1985 | Zieff |
| 4,574,174 | A | 3/1986 | McGonigle |
| 4,576,309 | A | 3/1986 | Tzifkansky et al. |

(List continued on next page.)

FOREIGN PATENT DOCUMENTS

| | | |
|---|---|---|
| EP | 1 279 605 A2 | 1/2003 |
| GB | 2 121 672 A | 1/1984 |
| WO | 03/067998 | 8/2003 |

OTHER PUBLICATIONS

U.S. Appl. No. 10/685,734, filed Oct. 15, 2003.
U.S. Appl. No. 29/191,893, filed Oct. 15, 2003.
U.S. Appl. No. 29/191,881, filed Oct. 15,2003.
Reginald L. Sanders, Sr.; "The Fresh Vegetable Keeper," Invention Submission to S. C. Johnson & Son, Inc., Sep. 30, 2003.

*Primary Examiner*—Robin A. Hylton

(57) ABSTRACT

A container (100) includes a bowl (200) and a lid (300) for the bowl (200). The lid (300) includes at least one opening (330). The lid (300) can be sealed to the bowl (200) in a plurality of orientations, including (i) an open orientation and (ii) a closed orientation. In the open orientation, the opening (330) is arranged over the bowl (200) such that flow is allowed from the interior of the container (100) to the exterior of the container (100), and vice versa. In the closed orientation, no flow is allowed between the interior of the container (100) and the exterior of the container (100).

27 Claims, 10 Drawing Sheets

U.S. PATENT DOCUMENTS 4,590,078 A 5/1986 Umina
4,600,117 A 7/1986 Tzifkansky et al.
4,700,842 A 10/1987 Grusin
4,750,614 A 6/1988 Fischer et al.
4,765,506 A 8/1988 Fishman et al.
4,797,523 A 1/1989 Kohnen
4,844,263 A 7/1989 Hadtke
4,917,261 A 4/1990 Borst
4,917,262 A 4/1990 Mita
4,923,085 A 5/1990 Lillelund et al.
4,974,742 A 12/1990 Farrell et al.
4,986,438 A 1/1991 Borst
D316,513 S 4/1991 Wolff
D318,015 S 7/1991 DeCoster et al.
D318,234 S 7/1991 Lillelund et al.
5,065,889 A 11/1991 Conti
5,181,626 A 1/1993 Daenen et al.
D334,710 S 4/1993 Picozza
5,266,763 A 11/1993 Colombo
5,293,997 A 3/1994 Hustad et al.
D348,805 S 7/1994 Cautereels
5,348,181 A 9/1994 Smith et al.
5,356,026 A * 10/1994 Andress et al. ..... 206/508
5,377,860 A 1/1995 Littlejohn et al.
5,388,714 A 2/1995 Zutler
5,390,797 A 2/1995 Smalley et al.
5,405,561 A 4/1995 Dais et al.
5,489,036 A 2/1996 Arkins
5,492,705 A 2/1996 Porchia et al.
5,520,302 A 5/1996 Anderson et al.
5,542,234 A 8/1996 Wyslotsky et al.
5,554,093 A 9/1996 Porchia et al.
5,554,250 A 9/1996 Dais et al.
D375,653 S 11/1996 Ferris
5,618,111 A 4/1997 Porchia et al.
5,628,427 A * 5/1997 Hayes ..... 220/669
5,686,127 A 11/1997 Stockley, III et al.
5,758,793 A 6/1998 Forsyth et al.
5,806,710 A 9/1998 Shiffer et al.
5,894,953 A 4/1999 Ramirez
5,931,333 A 8/1999 Woodnorth et al.
5,972,292 A 10/1999 DeMeo
6,032,827 A 3/2000 Zettle et al.
D424,298 S 5/2000 Laib
6,105,810 A 8/2000 Daenen et al.
6,164,484 A 12/2000 Fiore et al.
6,170,696 B1 1/2001 Tucker et al.
D437,685 S 2/2001 Liu
D440,114 S 4/2001 Lillelund et al.
6,213,302 B1 4/2001 Sanders et al.
6,216,905 B1 4/2001 Mogard et al.
6,217,136 B1 4/2001 Dorfman et al.
6,230,924 B1 5/2001 Weiss et al.
D444,034 S 6/2001 Miller et al.
D444,670 S 7/2001 Demers
D444,679 S 7/2001 Lillelund et al.
6,257,434 B1 7/2001 Lizzio
6,260,729 B1 7/2001 Mitchell et al.
6,260,731 B1 7/2001 Cummings
6,273,258 B1 8/2001 Piacenza
6,276,555 B1 8/2001 Edwards
6,279,788 B1 8/2001 Lillelund et al.
6,283,298 B1 9/2001 Seidler
6,305,546 B1 10/2001 Saunders et al.
6,325,234 B1 12/2001 Legaspi
6,343,709 B1 * 2/2002 DeForrest et al. ..... 220/327
6,349,820 B1 2/2002 Kelley et al.
6,364,112 B1 4/2002 Pitschka
6,364,152 B1 4/2002 Poslinski et al.
6,527,121 B1 3/2003 Flynn

* cited by examiner

CONTAINER WITH DETACHABLE, SELECTIVELY VENTED LID

BACKGROUND OF THE INVENTION

1. Field of the Invention

Our invention relates generally to a container, and, more specifically, to a container including a selectively vented lid that is detachably securable to the container.

2. Description of the Related Art

Containers, generally having a bowl and a lid, for storing food items and the like are well known. In recent years, consumer demand for more sophisticated containers has resulted in increased competition in the container industry. For example, today's consumers want, among other things, containers that are aesthetically pleasing and capable of withstanding extreme temperatures generally associated with freezing and/or microwaving of contents within the container.

Microwaving contents in a container, however, poses many problems. For example, with conventional food storage containers, if the lid is left sealed to the bowl of the container when heating food stored within, there is no way to vent the inside of the container to the ambient air. Consequently, as the container contents are warmed in a microwave oven, air within the container expands and, inevitably, the container deforms, or worse, the lid bursts off, splattering the contents of the container all over the inside of the microwave oven. This may also cause damage to the container.

Of course, to avoid such deformation, the lid could be removed from the bowl during microwaving. As the open bowl is warmed, however, it is not uncommon for any liquid contents to splatter. Thus, without a lid, this splattering will again lead to a soiled microwave oven.

Conventional attempts to avoid these problems typically involve removing the lid and setting it loosely on the bowl, prior to heating the contents of the container. However, if the lid is not offset relative to the bowl during heating, a vacuum can be created between the lid and the bowl, and the aforementioned problem of container deformation is not averted. Additionally, even when the lid is offset on the bowl, the aforementioned splattering problem may be lessened, but it is not eliminated. Also, when the lid rests loosely on the bowl, two items (i.e., the bowl and the lid) must now be removed from the microwave oven, both having the potential of being hot and, therefore, uncomfortable to the touch.

SUMMARY OF THE INVENTION

Our invention provides a versatile container that addresses a number of consumer needs, such as those noted above.

According to one aspect of our invention, a container includes a bowl having a rim and a lid detachably securable to the bowl. The lid has at least one opening and a peripheral sealing lip that, when the lid is secured to the bowl, engages at least a portion of the rim of the bowl. A seal is formed between the lid and the bowl. The lid is securable to the bowl in a plurality of orientations, including (i) an open orientation in which the opening allows flow between the inside of the container and the outside of the container, and (ii) a closed orientation in which the opening does not allow flow between the inside of the container and the outside of the container.

In another aspect, our invention relates to a container including a bowl and a lid for the bowl. The bowl includes a base, a rim, and at least one upstanding sidewall between the base and the rim. The lid includes a central panel, a peripheral sealing lip, and at least one opening spaced inwardly from the peripheral sealing lip. The peripheral sealing lip is detachably enagagable with at least a portion of the rim of the bowl in a plurality of orientations. A seal is formed between the lid and the bowl in each of the orientations. The orientations include (i) an open orientation in which the opening allows flow between the inside of the container and the outside of the container, and (ii) a second orientation in which the opening does not allow flow between the inside of the container and the outside of the container.

A better understanding of these and other features and advantages of our invention may be had by reference to the drawings and to the accompanying description, in which preferred embodiments of the invention are illustrated and described.

BRIEF DESCRIPTION OF THE DRAWINGS

Throughout the figures, like or corresponding reference numerals designate like or corresponding parts.

DESCRIPTION OF THE PREFERRED EMBODIMENTS

Figure 1:
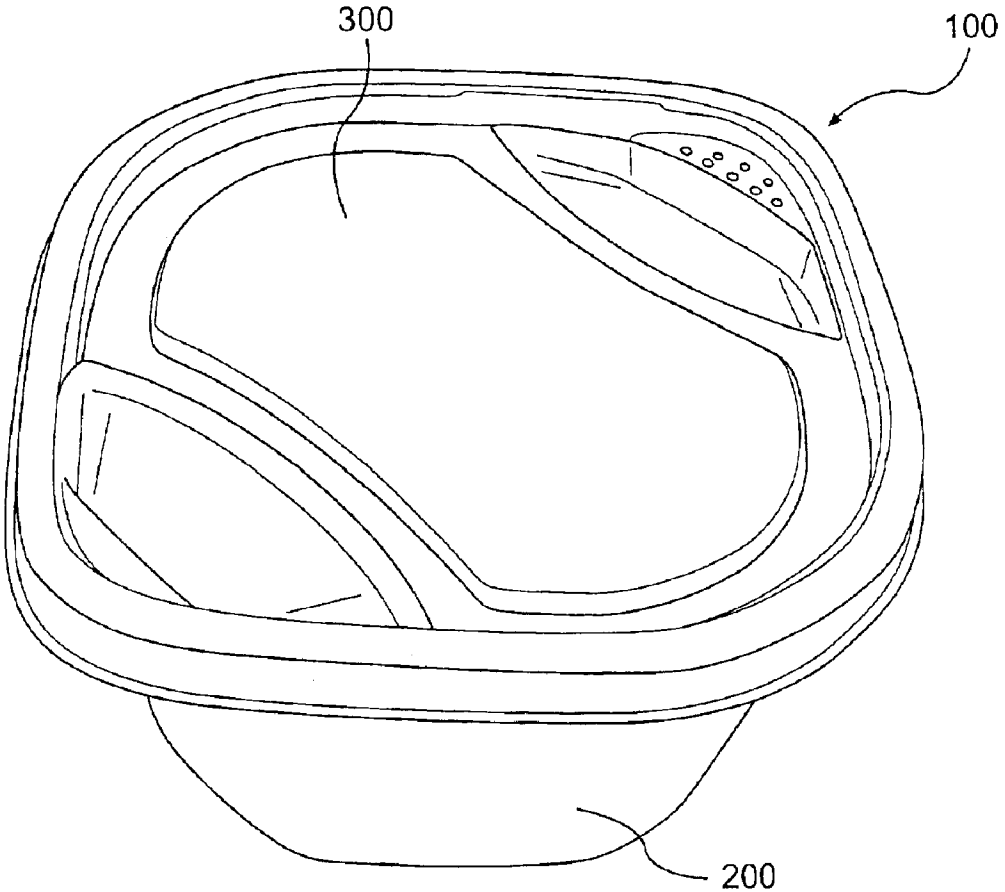
FIG. 1 is a perspective view of a container including a lid and a bowl according to one embodiment of our invention.
Figure 2:
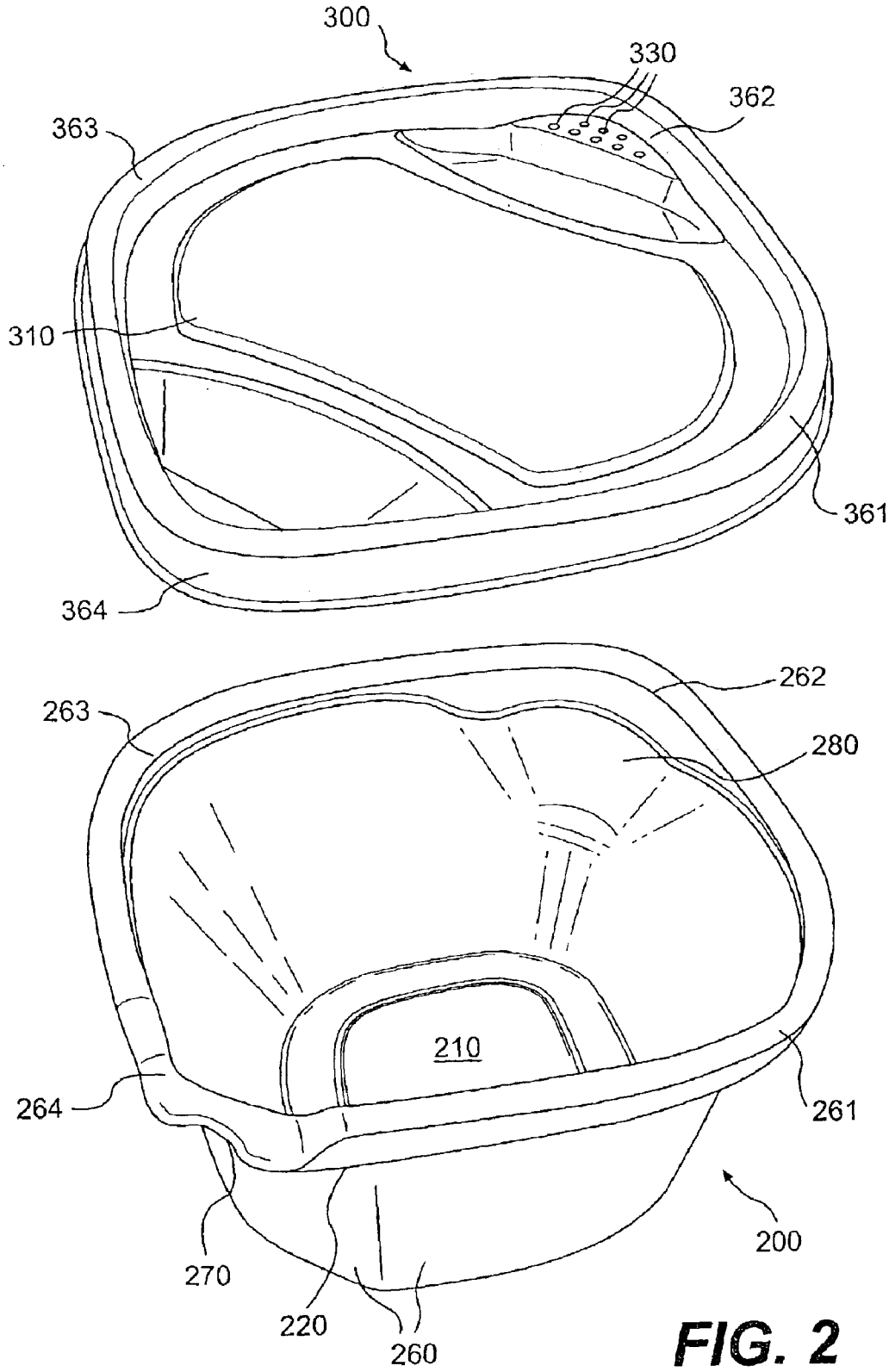
FIG. 2 is a perspective view of the container shown in FIG. 1, with the lid removed from the bowl.

A container 100 according to a preferred embodiment of our invention is illustrated in FIGS. 1–10. Generally, the container 100 includes a bowl 200 and a lid 300.

As illustrated in FIGS. 2–5, the bowl 200 includes a base 210, sidewalls 260 extending generally upward from the periphery of the base 210, and a rim 220 formed at the distal termination of the sidewalls 260. In the preferred embodiment, as shown best in FIG. 5, the bowl is generally of a four-sided polygonal shape with a radius of curvature at each of the four comers 261, 262, 263, 264. Other shapes for the bowl 200 can also be employed, such as, for example, circular, oval, or polygonal shapes, or combinations of more than one of these shapes.

Figure 5:
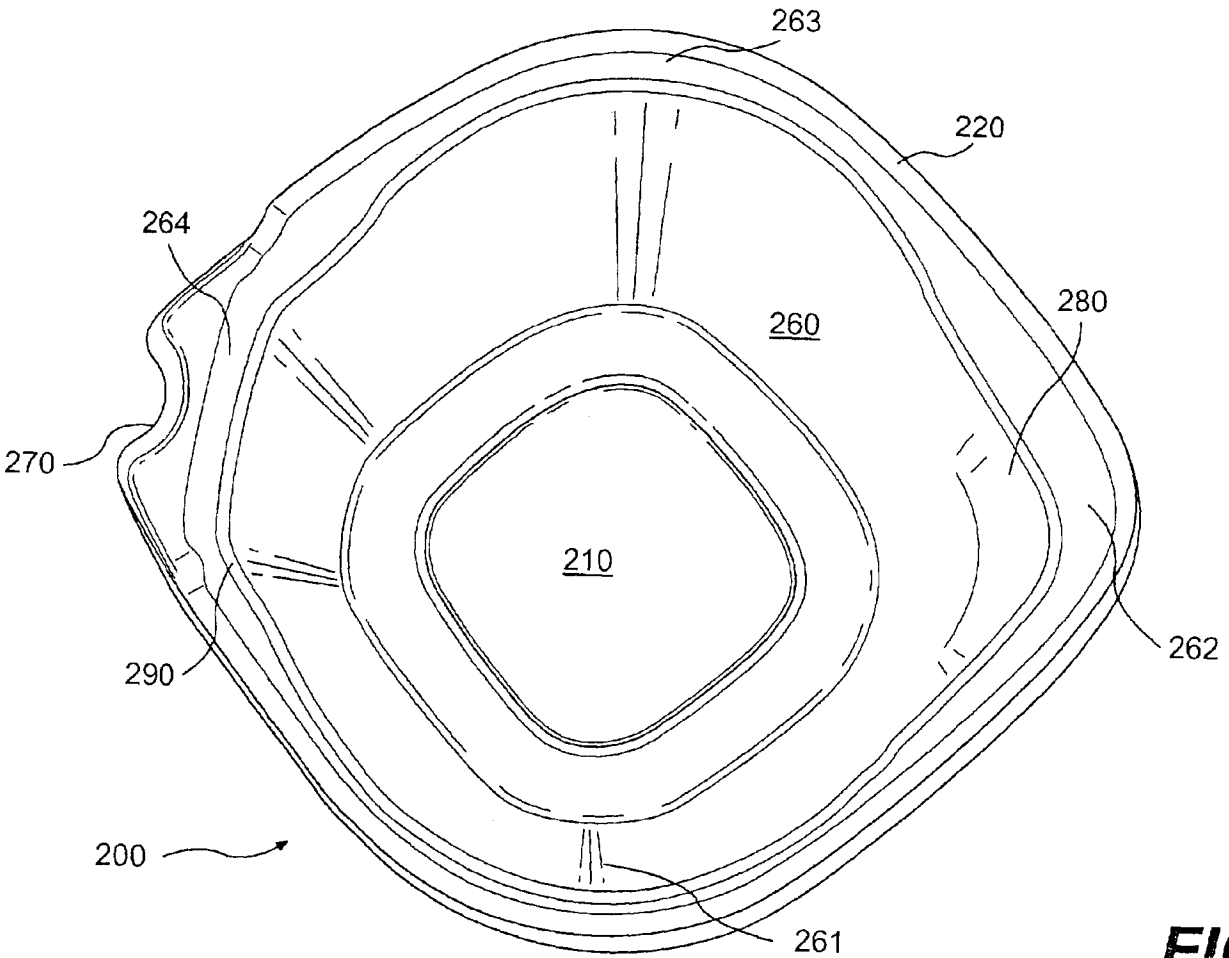
FIG. 5 is a perspective view of the bowl shown in FIG. 1.

In addition to varying the shape of the bowl 200, other modifications are anticipated within the scope of our invention. For example, as also illustrated by FIG. 5, the bowl 200 can have a cutout 270 disposed along the periphery of the bowl 200. The cutout 270 allows a user to firmly grasp both the top and bottom of the lid 300 to facilitate easy removal of the lid 300 and/or to facilitate "burping" of the container 100 when the lid 300 is secured to the bowl 200. While the cutout 270 in FIG. 5 is shown at the corner 264 of the bowl 200, the cutout 270 could be located anywhere along the periphery of the bowl 200, or there may be more than one cutout 270, for example, at opposite comers of the bowl 200.

Figure 3:
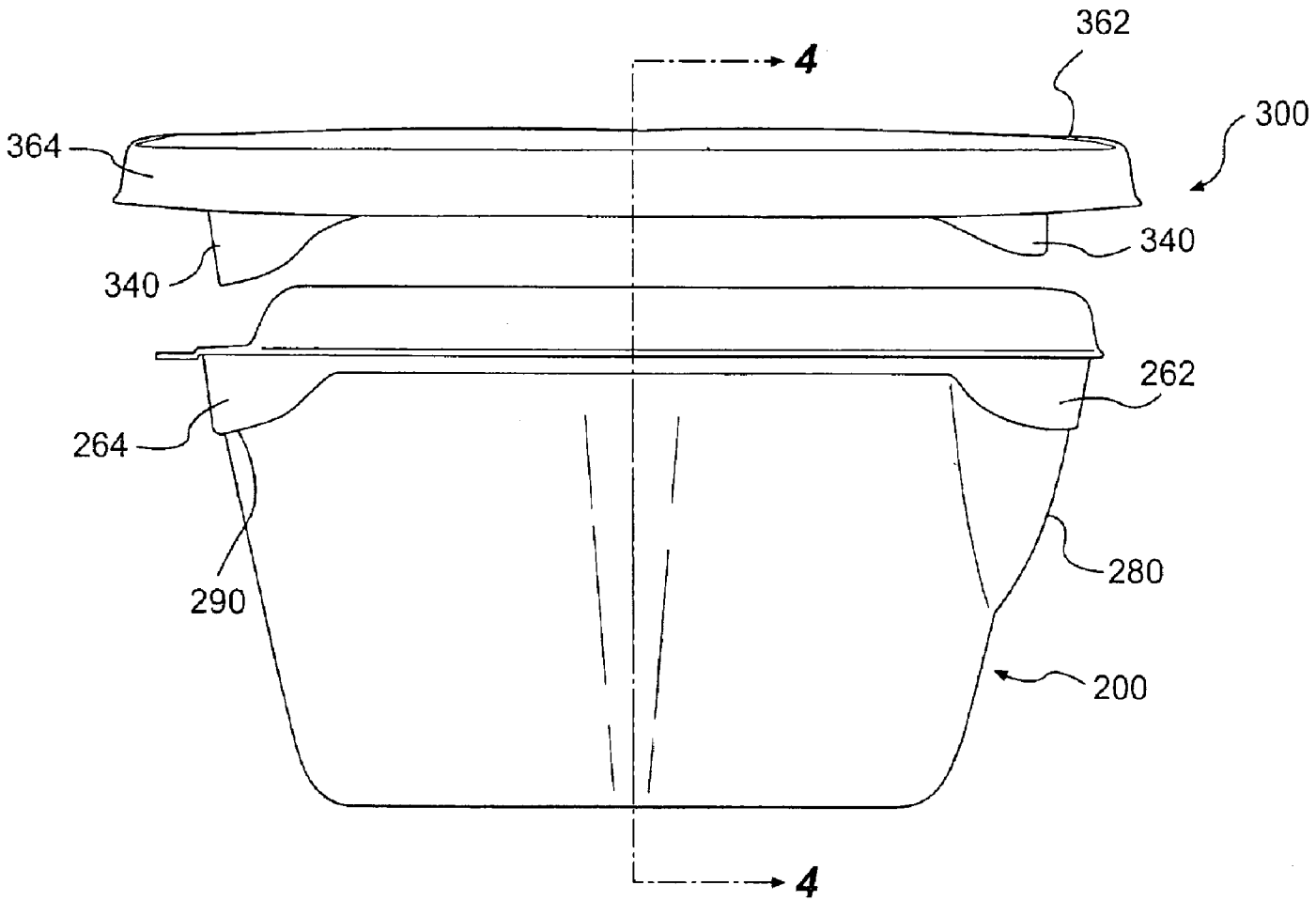
FIG. 3 is a side view of the container shown in FIG. 1, with the lid removed from the bowl.

The bowl 200 may also include at least one contoured spout 280. As best illustrated by FIGS. 3 and 5, the sidewalls 260 forming the corner 262 of the bowl 200 extend away from the inside of the bowl 200 to form the spout 280. The spout 280, for example, facilitates pouring of a liquid contained within the bowl 200.

Figure 4:
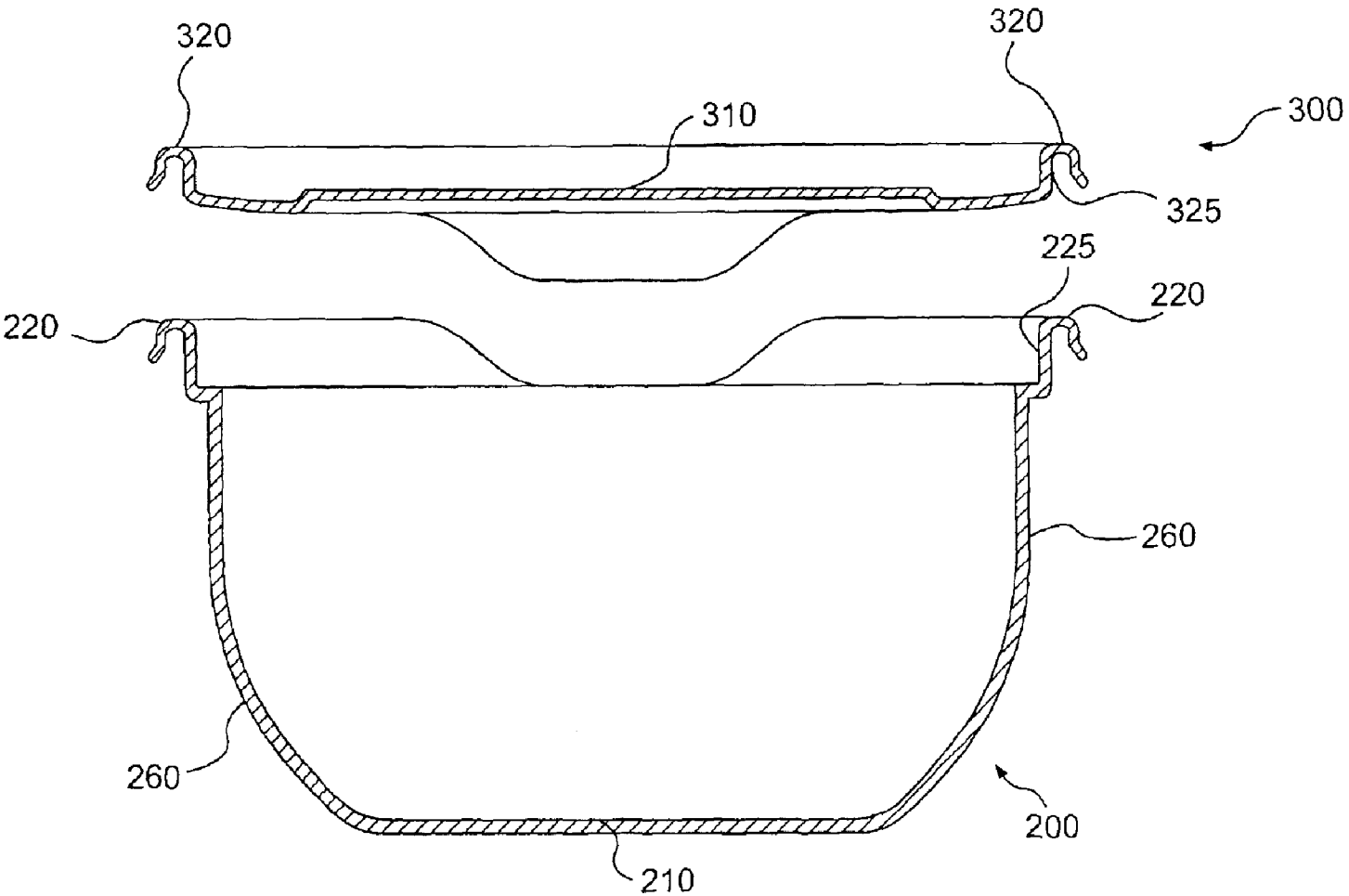
FIG. 4 is a cross-sectional view taken along section line 4—4 in FIG. 3.

As best illustrated in FIG. 4, the distal termination of the sidewalls 260 (with respect to the base 210) forms the rim 220. FIG. 4 shows that the rim 220 constitutes a substantially U-shaped cross-sectional configuration. Other possible cross-sectional shapes for the rim 220 may include, for example, semi-circular, polygonal, and the like.

While the U-shaped portion of the rim 220 of the bowl 200 may extend continuously about the bowl 200, it need only be on a substantial portion of the rim 220 of the bowl 200. For example, as shown in FIG. 5, the rim 220 in the corner 264 of the bowl 200 is substantially flat and parallel to the base 210, i.e., the rim 220 does not include the U-shaped profile.

The bowl 200 may further include one or more recesses 290. As shown in the preferred embodiment, specifically in FIGS. 3 and 5, a recess 290 is located proximate to the corner 264, in the interior of the bowl 200. The function of the recess 290 will be discussed below.

The lid 300 includes a central panel 310 and a peripheral sealing lip 320. As best illustrated in FIG. 4, the sealing lip 320 is substantially U-shaped in cross section and fits snugly over the correspondingly-shaped rim 220 of the bowl 200 when the lid 300 is secured to the bowl 200. Preferably, the inner-facing portion of the rim 220, i.e., the portion proximate to the sidewall 260, forms a bowl sealing surface 225 that contacts the lip sealing surface 325, which is an outward facing portion of the sealing lip 320, proximate to the central panel 310. The contact between the bowl sealing surface 225 and the lip sealing surface 325 preferably forms an airtight seal between the lid 300 and the bowl 200. As a result of this seal, all, or substantially all, flow (i.e., flow of gaseous, liquid, and/or solid substances) between the bowl 200 and the lid 300 from the interior of the container 100 to the exterior of the container 100, and vice versa, is prohibited. Additionally, the seal between the lid 300 and the bowl 200 allows the container 100 to be inverted or tilted without the lid 300 becoming dislodged from the bowl 200. As will be seen below, such a feature allows for versatility of the container 100. Alternatively, the seal between the bowl 200 and the lid 300 may be achieved through a tongue-in-groove style arrangement or some other seal geometry.

Figure 6:
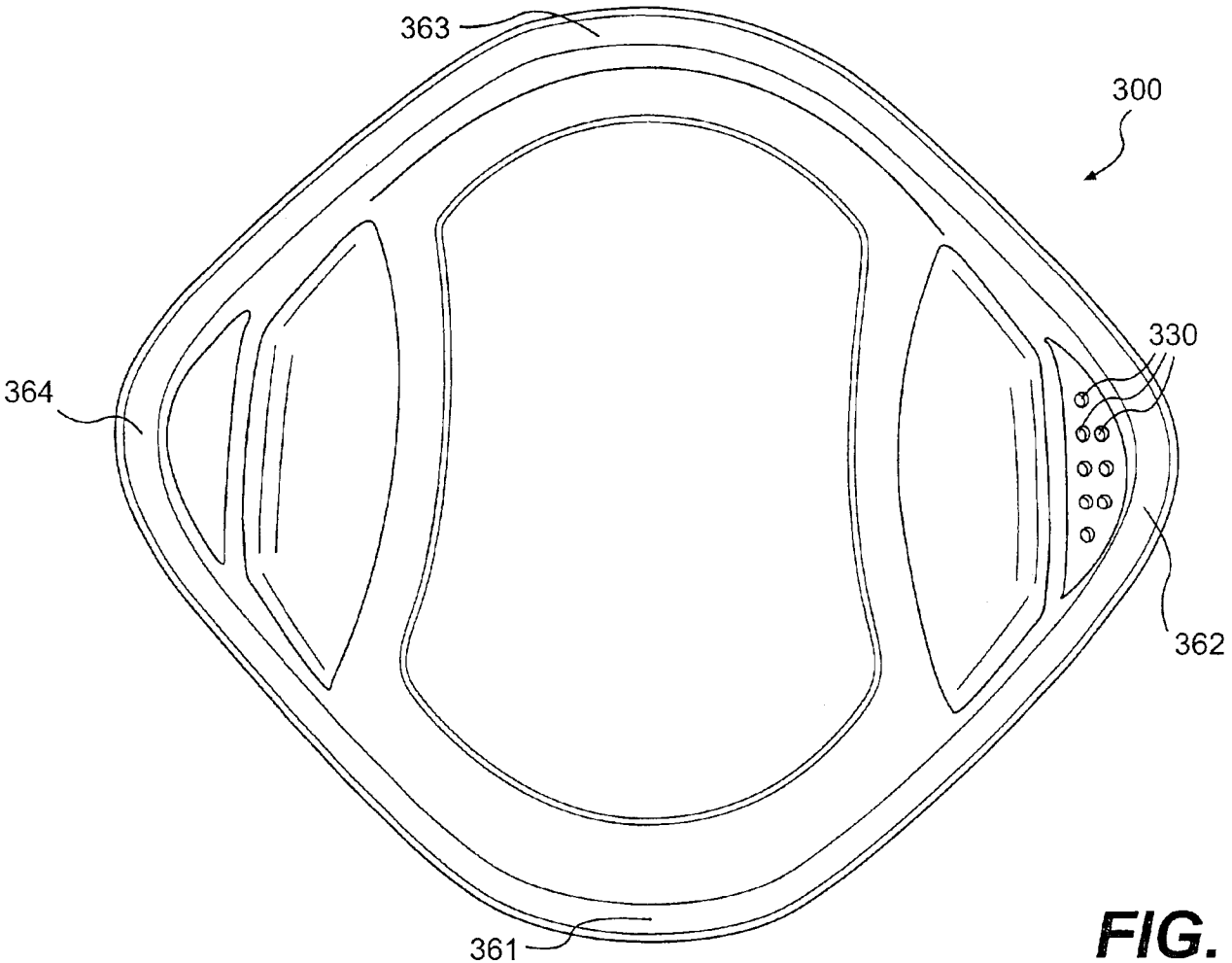
FIG. 6 is a top view of the lid shown in FIG. 1.

The lid 300 is further characterized in that it includes at least one opening 330. In the embodiment of FIG. 6, for example, the opening 330 comprises plural apertures formed through the lid 300, spaced inwardly from the peripheral sealing lip 320. The apertures are arranged in a pattern, proximate to the corner 362 of the lid 300. The opening 330 allows for the passage of substances, for example, air, water, and the like, from one side of the lid 300 to the other side of the lid 300. While the embodiment of FIG. 6 depicts plural apertures in the corner 362 of the lid 300, this is not a requirement. For example, the opening 330 may consist of plural apertures located in more than one corner, i.e., any or all of the comers 361, 362, 363, 364, or about part or all of the periphery of the lid 300. Or, the opening may comprise a single aperture.

Additionally, as best illustrated in FIG. 3, the lid 300 may also include at least one downwardly extending protrusion 340. The protrusion 340 is generally formed to extend proximate to a sidewall 260 of the bowl 200, inside the bowl 200, when the lid 300 is placed on the bowl 200. In the preferred embodiment, the protrusion 340 is disposed on the lid 300 in a position to correspond with a portion of the rim 220 that does not include the substantially U-shaped cross section described above. More specifically, because an airtight seal is not readily achieved between the bowl 200 and the lid 300 at a section of the rim 220 that does not include the bowl sealing surface 225 to mate with the lid sealing surface 325, the extension 340 completes the seal between the bowl 200 and the lid 300 about the entire container 100 by abutting a sidewall 260 inside the bowl 200. Preferably, this seal is airtight. Furthermore, as discussed above, and as shown in FIG. 5, the bowl 200 may have a recess 290 with which the protrusion 340 of the lid 300 preferably mates.

Further modifications to the lid 300 are also contemplated. For example, the lid 300 may include at least one tab (not shown) disposed on the periphery of the lid 300. The tab extends from the lid 300 to facilitate removal of the lid 300 by a user.

Having thus described the construction of the container 100 of our invention, the use of our invention will now be described.

Generally, the lid 300 may be secured to the bowl 200 in a plurality of orientations. For example, as shown in FIGS. 7–10, with the bowl 200 (shown in phantom lines in FIGS. 7 and 9) being held stationary, the lid 300 may be placed on the bowl 200 in two distinct orientations, i.e., at rotational intervals of 180°. Of course, depending on the shape of the bowl 200 and the lid 300, there may be any number of orientations. For example, if the bowl 200 and the lid 300 are generally square in shape, the lid 300 may be securable to the bowl 200 in any of four orientations, i.e., at roatational intervals of 90°. Similarly, for any other polygonal shape, more or fewer orientations may be achieved, and for a circular shape, the number of orientations is infinite.

Figure 7:
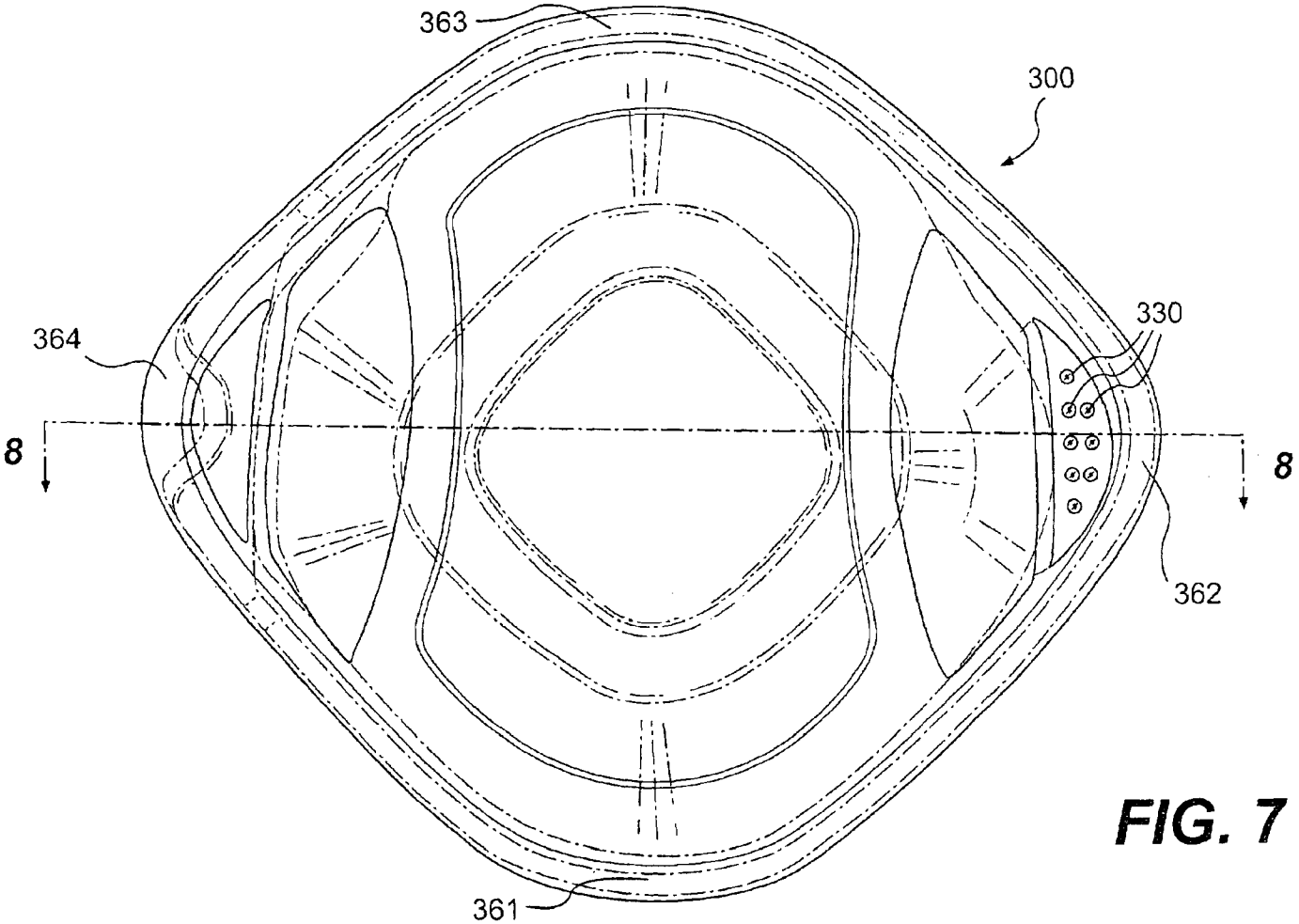
FIG. 7 is a top view of the container shown in FIG. 1, with the lid secured to the bowl in a first, open orientation.
Figure 8:
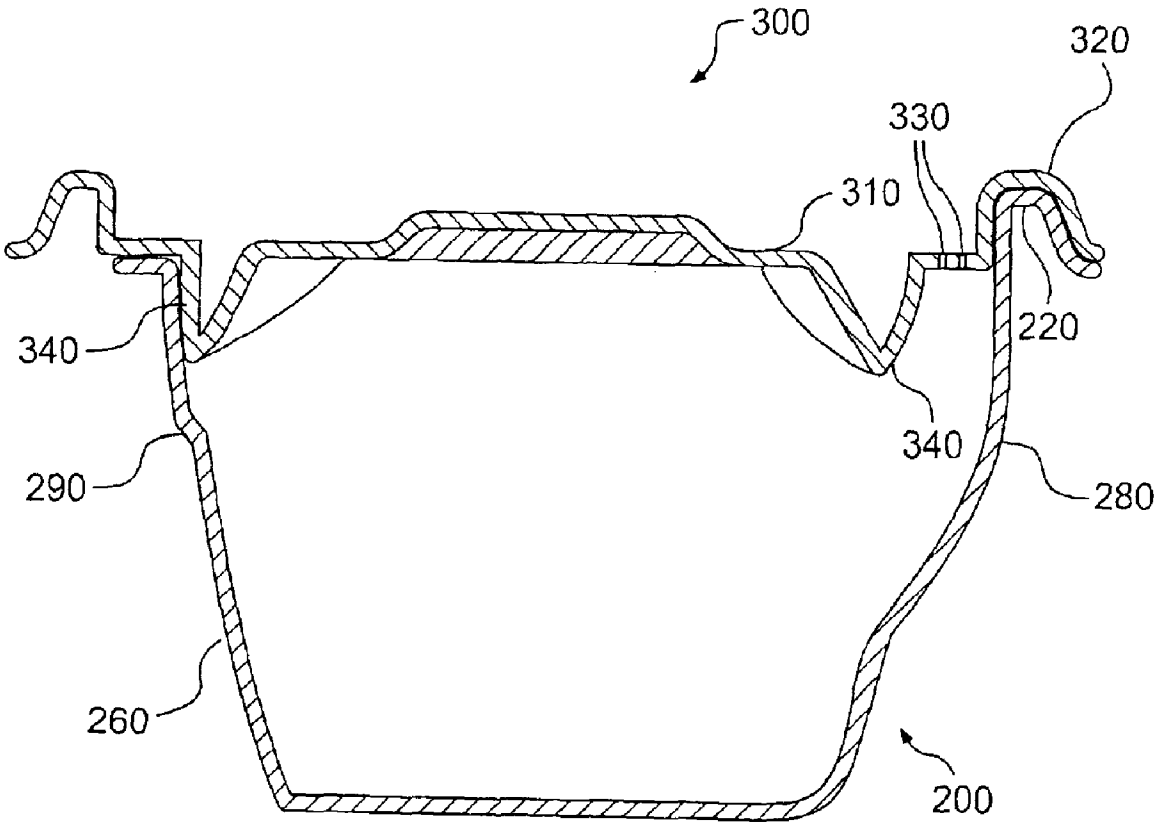
FIG. 8 is a cross-sectional view taken along section line 8—8 in FIG. 7.

Regardless of the number of orientations in which the lid 300 can be secured to the bowl 200, in at least one orientation, e.g., the "open" orientation illustrated in FIGS. 7 and 8, the opening 330 is disposed over the opening of the bowl 200, i.e., the opening 330 is disposed over the cavity formed within the sidewalls 260 of the bowl 200. As such, the opening 330 allows for substances to flow from the inside of the sealed container 100 to the outside of the sealed container 100, and from the outside of the sealed container 100 to the inside of the sealed container 100. As a specific example, the opening 330 acts as an air vent and allows air to flow through the lid 300, thus venting the contents of the container 100 during, for example, microwaving of contents in the container 100. Also, for example, the container 100, in the open orientation, may be used as a strainer. Specifically, as discussed above, because the container 100 is sealed between the bowl 200 and the lid 300, the container 100 may be inverted and only the opening 330 will allow for passage of the contents in the container 100. Because the lid 300 will remain sealed to the bowl 200 when the container 100 is inverted, the bowl can strain liquids such as, for example, condensed moisture or a liquid sauce, from inside the container 100. As a result, any undesired liquid can be separated from the remaining contents of the container 100, which cannot fit through the opening 330. Also, the container 100, with the opening 330 allowing the flow of some contents from the container 100, can be used as a shaker for dispensing, for example, grated cheese, bacon bits, spices, and the like.

Figure 9:
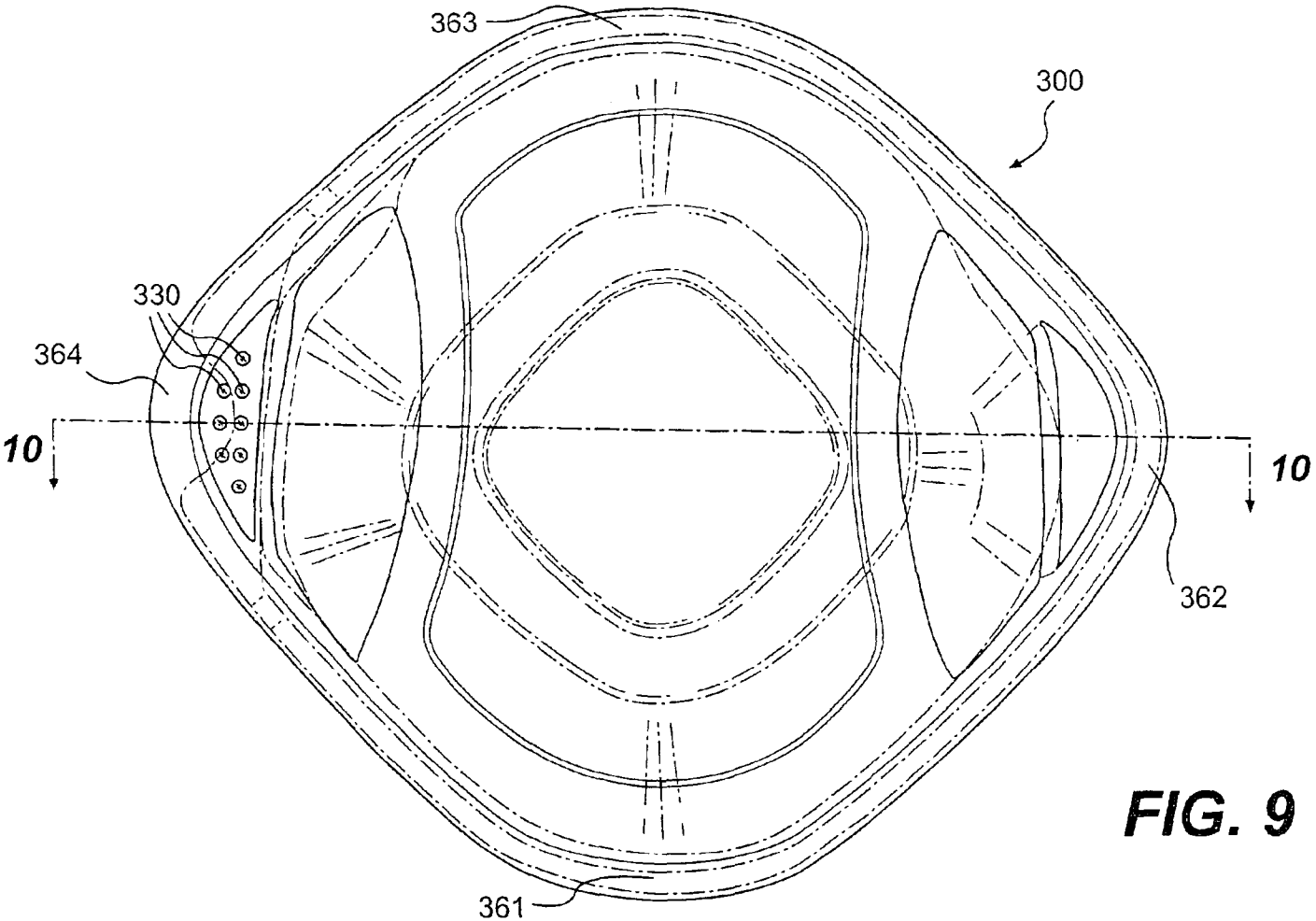
FIG. 9 is a top view of the container shown in FIG. 1 with the lid in a second, closed orientation.
Figure 10:
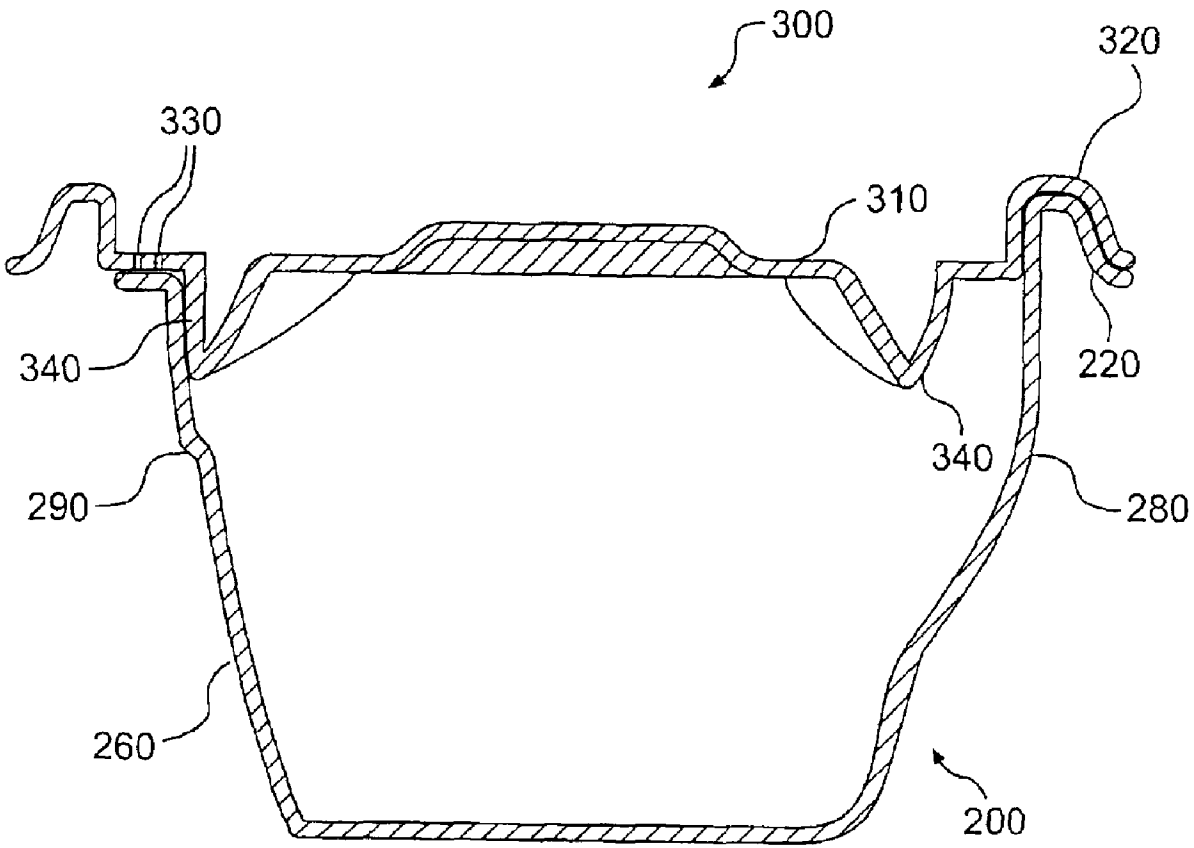
FIG. 10 is a cross-sectional view taken along section line 10—10 in FIG. 9.

While the open orientation allows for flow from the inside of the container 100 to the outside of the container 100, and vice versa, FIGS. 9 and 10 depict another orientation, i.e., the "closed" orientation. In the closed orientation, there cannot be any flow into and out of the sealed container 100 through the opening 330. In this orientation, the contents of the container are completely sealed within the container 100. This is generally the orientation used for storing the contents of the container 100 in, for example, a refrigerator, a cupboard, or the like. More specifically, as shown in FIGS. 9 and 10, because the opening 330 in the preferred embodiment is positioned in the corner 362 near the periphery of the lid 300, the opening 330 is not positioned above the opening of the bowl 200 (i.e., the cavity formed between the sidewalls 260) when the lid 300 is in the closed orientation.

As best illustrated in FIG. 5, in the preferred embodiment, the open and closed orientations are facilitated by the spout 280 in the corner 262 and by the cutout 270 in the corner 264. Specifically, because of these different formations in the opposite comers 262, 264, the opening of the bowl 200 is not symmetrical about a plane drawn perpendicular to the base 210 of the bowl 200 and passing through the corner 261 and the corner 263. However, because of the features discussed above, the lid 300, which is preferably symmetrical about the plane just described, may still be secured to the bowl 200 in plural orientations, at least one of which allows substances to flow to/from the inside of the container 100 (open orientation), but at least one of which does not allow such flow (closed orientation).

Other methods of achieving the two orientations are also contemplated. As shown in FIG. 10, for example, in the closed orientation, the opening 330 is not disposed over the opening of the bowl, i.e., the cavity formed within the sidewalls 260, but is disposed partially on the rim 220 of the bowl 200 from which the cutout 270 (see FIG. 5) is removed, and partially in the removed portion. Alternatively, the opening 330 may be wholly in the removed portion of the cutout 270 such that the at least one opening 330 allows flow completely therethrough. This may be advantageous because foreign substances, e.g., dirt, food, water, and the like, cannot collect in the opening 330 on the rim 220 of the bowl. Further, when no cutout 270 is used, or in conjunction with a cutout 270, a ledge (not shown) may be disposed on the inside of the bowl 200. When the lid 300 is placed on the bowl 200 in the closed orientation, the opening 330 is disposed on the ledge, thereby not allowing flow into and out of the container 100, and also not allowing any flow through the opening 330. The ledge may be formed as a portion of the bowl 200, or may be a separate part, attached to the bowl 200.

Preferably, the bowl 200 and the lid 300 are made of polypropylene. Alternatively, these components can be made of polyethylene, polystyrene, CPET (crystalline polyethylene terephthalate), polycarbonate, and/or other plastic materials. Metal materials could also be used, although metal is generally not suitable for microwaving. Alternatively, glass or ceramic could be used. The bowl 200 and the lid 300 need not be made of the same material.

Preferably, the bowl 200 and the lid 300 are made by a thermoforming process. It is further contemplated, however, that these components could be made by other processes, including, for example, blow-molding or injection-molding. As one of skill in the art would understand, making the bowl 200 and the lid 300 from another process would result in some minor structural modifications to the bowl 200 and the lid 300.

The embodiments discussed above are representative of preferred embodiments of our invention and are provided for illustrative purposes only. They are not intended to limit the scope of the invention. Although specific shapes, configurations, materials, etc., have been shown and described, such are not limiting. Modifications and variations are contemplated within the scope of our invention, which is intended to be limited only by the scope of the accompanying claims.

INDUSTRIAL APPLICABILITY

This invention relates to a container of the type used to store food items and the like. The container includes a bowl having a rim and a lid, detachably securable to the bowl. The lid includes at least one opening and a peripheral sealing lip that, when the lid is secured to the bowl, engages at least a portion of the rim. The lid is securable to the bowl in a plurality of orientations. A seal is formed between the lid and the bowl when the lid is secured to the bowl. In an open orientation, the opening allows flow from inside the container to outside the container and from outside the container to inside the container. In a closed orientation, no flow is allowed from inside the container to outside the container, or from outside the container to inside the container.

We claim:

1. A container comprising:

a bowl having a rim; and a lid, detachably securable to the bowl, the lid including at least one opening and a peripheral sealing lip that defines a channel in which at least a portion of the rim of the bowl is seated when the lid is secured to the bowl, forming a seal between the lid and the bowl, the at least one opening being spaced inwardly from the peripheral sealing lip, wherein the lid is securable to the bowl in a plurality of orientations, including (i) an open orientation in which the at least one opening allows flow between the inside of the container and the outside of the container, and (ii) a closed orientation in which the at least one opening is disposed other than over a cavity of the bowl and does not allow flow between the inside of the container and the outside of the container.

2. A container according to claim 1, wherein, in the closed orientation, the at least one opening is disposed over a portion of the rim, thereby preventing flow through the opening.

3. A container according to claim 1, wherein the bowl is substantially one of polygonal, rectangular, and circular in shape.

4. A container according to claim 1, the bowl further including a spout.

5. A container according to claim 4, wherein, in the open configuration, the at least one opening is proximate to the spout.

6. A container according to claim 4, the bowl further including a recess and the lid further including plural protrusions.

7. A container according to claim 6, wherein the spout of the bowl and the recess at the bowl are opposite to each other, at least two protrusions of the lid are opposite to each other, and, in each of the open orientation and the closed orientation, one of the protrusions abuts the recess, forming a seal between the protrusion of the lid and the recess of the bowl.

8. A container according to claim 1, wherein the at least one opening is an air vent that allows air to flow therethrough when the lid is secured to the bowl in the open configuration.

9. A container according to claim 1, wherein the at least one opening is at least one aperture that allows at least one of the group consisting of liquids and solids to flow therethrough when the lid is secured to the bowl in the open configuration.

10. A container comprising:

a bowl including a base, a rim, and at least one upstanding sidewall between the base and the rim;

and a lid for the bowl, the lid including a central panel, a peripheral sealing lip that defines a channel in which at least a portion of the rim of the bowl is seated when the lid is secured to the bowl, and at least one opening spaced inwardly from the peripheral sealing lip, wherein the peripheral sealing lip is detachably engageable with at least a portion of the rim of the bowl and a seal is formed between the lid and the bowl in a plurality of orientations, including (i) an open orientation in which the at least one opening allows flow between the inside of the container and the outside of the container, and (ii) a second orientation in which the at least one opening is disposed other than over a cavity of the bowl and does not allow flow between the inside of the container and the outside of the container.

11. A container according to claim 10, wherein the bowl includes means for physically obstructing the at least one opening when the lid is in the second orientation.

12. A container according to claim 11, wherein the means for physically obstructing the at least one opening is the rim.

13. A container according to claim 10, wherein the bowl is substantially one of polygonal, rectangular, and circular in shape.

14. A container according to claim 10, wherein the bowl further includes a spout.

15. A container according to claim 14, wherein the at least one opening of the lid is proximate to the spout of the bowl when the lid is secured to the bowl in the open orientation.

16. A container according to claim 14, the bowl further including a recess and the lid further including plural protrusions.

17. A container according to claim 16, wherein the spout of the bowl and the recess of the bowl are opposite to each other, at least two protrusions of the lid are opposite to each other, and, in each of the open orientation and the second orientation, one of the protrusions abuts the recess, forming a seal between the protrusion of the lid and the recess of the bowl.

18. A container according to claim 10, wherein the at least one opening is an air vent that allows air to flow therethrough when the lid is sealed to the bowl in the open configuration.

19. A container according to claim 10, wherein the at least one opening is at least one aperture that allows at least one of the group consisting of liquids and solids to flow therethrough when the lid is secured to the bowl in the open configuration.

20. A container comprising:

a bowl having a base, a rim, and at least one upstanding sidewall between the base and the rim, the rim having a bowl sealing surface formed on an inwardly-facing portion of the rim, proximate to the sidewall, the sidewall having a recess', a lid for the bowl, the lid including a central panel, a peripheral sealing lip that defines a channel in which at least a portion of the rim of the bowl is seated when the lid is secured to the bowl, at least one opening spaced inwardly from the peripheral sealing lip, and a plurality of protrusions, the peripheral sealing lip having a lid sealing surface formed on an outwardly facing portion of the sealing lip, proximate to the central panel, wherein the bowl sealing surface and the lid sealing surface, and the recess of the bowl and one of the protrusions of the lid, are detachably securable, such that, when secured in any of plural orientations, a seal is formed between the bowl and the lid, the orientations including (i) an open orientation in which the at least one opening allows flow between the inside of the container and the outside of the container, and (ii) a second orientation in which the at least one opening is disposed other than over a cavity of the bowl and does not allow flow between the inside of the container and the outside of the container.

21. A container according to claim 20, the bowl further comprising a contoured spout opposite the recess.

22. A container according to claim 20, wherein the bowl is substantially one of polygonal, rectangular, and circular in shape.

23. A container according to claim 20, herein the at least one opening is an air vent that allows air to flow therethrough when the lid is sealed to the bowl in the open configuration.

24. A container according to claim 20, wherein the at least one opening is at least one aperture that allows at least one of the group consisting of liquids and solids to flow therethrough when the lid is secured to the bowl in the open configuration.

25. A container according to claim 1, wherein the peripheral sealing lip has a substantially U-shaped cross section.

26. A container according to claim 10, wherein the peripheral sealing lip has a substantially U-shaped cross section.

27. A container according to claim 20, wherein the peripheral sealing lip has a substantially U-shaped cross section.

* * * * *